United States Patent [19]

Leboeuf

[11] 4,430,825

[45] Feb. 14, 1984

[54] EDUCATIONAL TOY USING NUMERICAL FIGURES TO FORM A HUMAN HEAD

[76] Inventor: Michel Leboeuf, 24, 3rd Ave., East, La Sarre, Province of Quebec, Canada, J0Z 2M0

[21] Appl. No.: 271,632

[22] Filed: Jun. 8, 1981

[51] Int. Cl.[3] ..... A63H 33/00

[52] U.S. Cl. ..... 46/22; 434/82; 434/193

[58] Field of Search ..... 46/22, 17, 16, 35, 115, 46/1 R, 164; 434/403, 81, 82, 193, 195; 40/618; 273/157 R, 156, 160, 46, 434, 273

[56] References Cited

U.S. PATENT DOCUMENTS

| | | | |
|---|---|---|---|
| 3,090,155 | 5/1963 | Gordon | 46/22 |
| 3,210,884 | 10/1965 | Sharff et al. | 46/22 |
| 3,618,956 | 11/1971 | Biederer | 273/157 R |
| 3,822,487 | 7/1974 | Koch | 46/26 X |
| 3,918,178 | 11/1975 | Riley | 273/156 X |

*Primary Examiner*—Mickey Yu

[57] ABSTRACT

An educational toy based on the use of three-dimensional numerical figures which can be more easily memorized upon their manipulation by a child and which are constructed and arranged to be interconnected to form a three-dimensional representation of a human head having different facial expressions representative of different moods, such as sadness, sorrow, joy, fright, surprise, etc. This toy includes a plurality of three-dimensional numerical figures including the ten different numerical figures forming the arabic numbers and having each a connecting aperture, projection or both to removably interconnect sets of those figures to form different facial expressions.

1 Claim, 9 Drawing Figures

EDUCATIONAL TOY USING NUMERICAL FIGURES TO FORM A HUMAN HEAD

FIELD OF THE INVENTION

This invention relates to an educational toy of the type based on the use of numerical figures.

DESCRIPTION OF PRIOR ART

It is current practice and very efficient to use educational toys for teaching, such as at the kindergaten or primary school. Such toys are proven to be very efficient teaching aids and now appear rather indispensable for teachers.

SUMMARY OF THE INVENTION

It is a general object of the present invention to provide a toy of the above type which allows enjoyable and instructive use of numerical figures.

It is an object of the present invention to provide a toy of the above type which can be used by teachers or educators to enhance creativity and understanding of the numerals by young children through manipulation of numerical figures.

It is another object of the present invention to provide a toy of the above type which allows the child to free his imagination by construction of three dimensional representations of human heads having different facial expressions, such as sorrow, sadness, surprise, joy, fright, etc.

It is a more specific object of the present invention to provide a toy of the above type, which includes the ten different numerical figures forming the arabic numbers to teach those figures and mumbers in an enjoyable way for the child.

This toy includes a plurality of three-dimensional numerical figures including the ten different numerical figures forming the arabic numbers and having each a connecting aperture, projection, or both to removably interconnect sets of these figures to form three dimensional representations of human heads having different facial expressions.

BRIEF DESCRIPTION OF THE DRAWINGS

The above and other objects and advantages of the present invention will be better understood with reference to the following detailed description of a preferred embodiment thereof which is illustrated, by way of example, in the accompanying drawings, in which.

Figure 1:
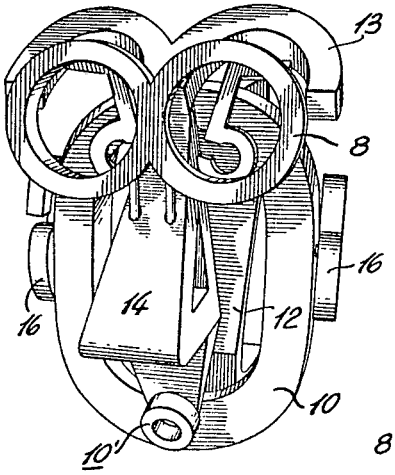
FIGS. 1 and 2 are front and side views, somewhat in perspective of one representation of a human head that is produced with a specific set of three-dimensional numerical figures according to the present invention.

As can be seen in the drawings, the numerical figures are made in one or the other of two different sizes, thus defining a larger size and a smaller size. Obviously, the numerical figures could be of many different sizes. The illustrated numerical figures are made of three-dimensional bodies including the ten different numerical figures from zero to nine (0 to 9) inclusive forming the arabic numbers. Each of those numerical figures or bodies is provided with one or more connection apertures 2, one or more connection projections 4, or a mixture of both for removable interconnection of sets of those figures or bodies to form a three-dimensional representation of a human head with different facial expressions.

Those bodies or three-dimensional numerical figures are preferably differently colored according to a color code in relation with its numerical shape. Thus, for instance, the zero may be orange, the one may be natural wood, the two may be red, the three may be light green, the four may be pink, the five may be yellow, the six may be dark green, the seven may be black, the eight may be maroon; and the nine may be blue.

As shown in the drawings, the zero is made in both sizes with the large zero 10 representing the outline of a human head and the small zero 10' representing either an eye or a mouth. The one is also made in both sizes with the larger one 11 representing a human nose and the smaller one 11' representing an eyebrow. The two 12 is only of larger size and represents the back of the head. The three 13 is only of the large size and represents either a pair of eyebrows or a mustache. The four 14 is only of the larger size and represents a human nose. The five 15 is only of the smaller size and represents an eye. The six 16 and the nine 19 are only of the smaller size and represent an ear. The seven 17 is only of the larger size and represents a human nose. The eight 18 is only of larger size and represents eye-glasses.

The projections or pins 4 may be of different geometrical cross-section to further add to the educational aspect.

As can be seen from comparison of the different Figures of the drawings, different sets of numerical figures may be used to produce different facial expressions. For instance, FIGS. 1 and 2 use the numerical figures 0, 2, 3, 4, 5, 6, 8 or, in other words, the set 0-2-3-4-5-6-8. The following other sets are also suitable to produce corresponding facial expressions respectively: 0-2-7-9, 0-1-5-6-7-8-9, 0-1-2-3-6-7-9, 0-1-2-5-6-9, 0-1-2-3-4-5-6-8-9, 0-1-2-, 0-2-3-4-5-6-9, 0-2-4, 0-1-2-3-4-6-9; and 0-2-4-6-7-8-9.

Figure 2:
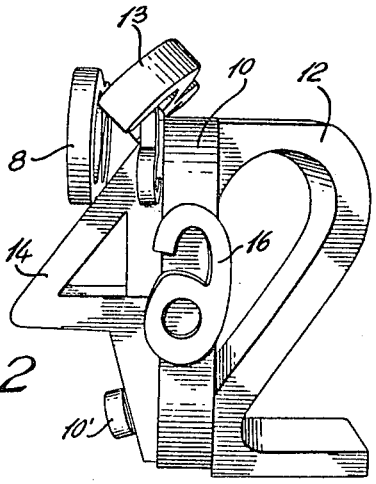
Figure 3:
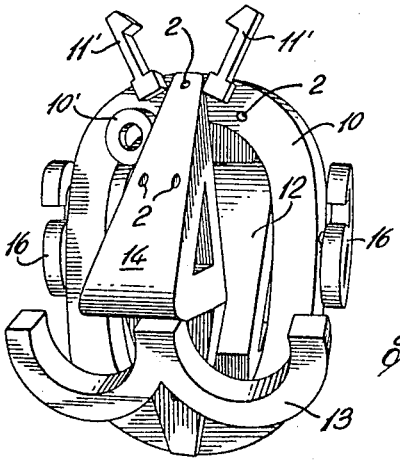
FIG. 3 is a perspective view of another of the facial expressions that can be formed with another set of numerical figures according to the present invention.
Figure 4:
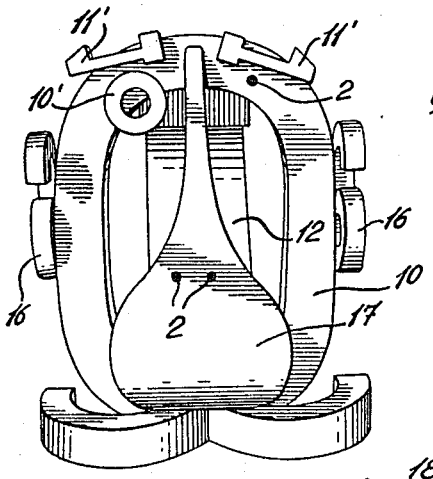
FIG. 4 is a perspective view of still another of the possible facial expressions.
Figure 5:
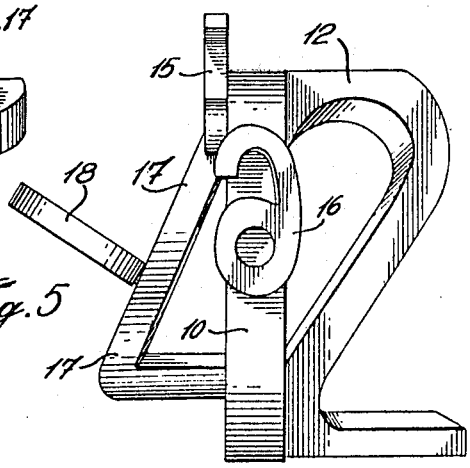
FIGS. 5 and 6 are side and front views, respectively, somewhat in perspective of still another of the facial expressions which may be made with the numerical figures according to the present invention.
Figure 6:
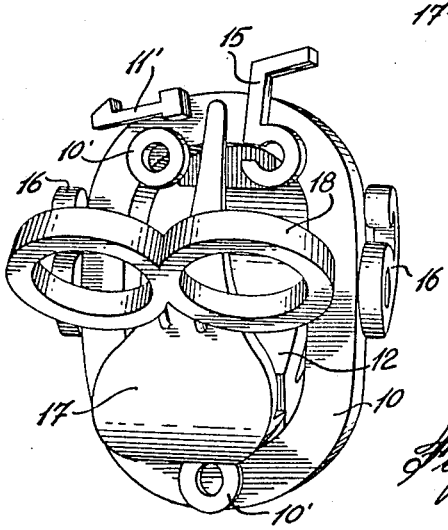
Figure 7:
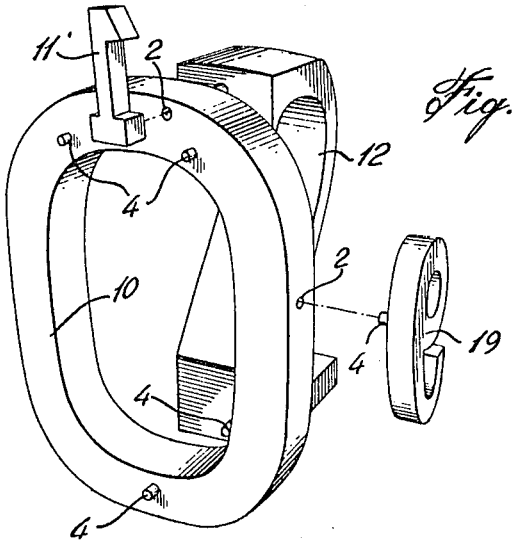
FIG. 7 is an exploded view in perspective illustrating the interconnection of numerical figures according to the present invention in the process of forming another of the possible facies.
Figure 8:
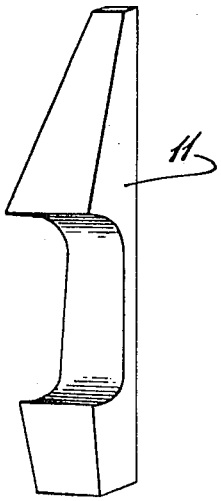
FIGS. 8 and 9 are perspective and side views, respectively, of a body in the shape of the arabic numeral 1 according to the present invention.
Figure 9:
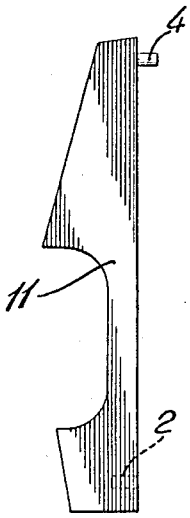

It will be readily understood that the connection apertures 2 and pins 4 are relatively arranged to sandwich a zero between a two and a one, or a four, as in FIGS. 1, 2, and 3, or a seven, as in FIGS. 4, 5, and 6. The ears are defined by either a pair of sixes 16 or a pair of nine 19 which are pinned on the opposite sides respectively of a zero 10. The mouth is defined by a small zero 10' pinned against the lower front portion of the one 11 or the four 14. The eyes are defined either by a small zero 10' or a small five 15, depending on the mood that is planned. The eyebrows are defined either by a three 13 or a pair of small ones 11' against producing a different effect or mood. A mustache is defined by pinning the three, either as in FIG. 3 or 4, against the lower portion of the figures that defines the nose.

What I claim is:

1. An educational toy comprising a plurality of different numerical figures, each one having a three-dimensional body defining surfaces at right angles to each other, at least one complete set of said numerical figures presenting the ten different arabic numerals, from 0 to 9 inclusively, the zero and the one being made in both a larger size and a smaller size, the two, the three, the four, the seven, and the eight are made only in said larger size, and the five, the six, and the nine are made only in said smaller size; said numerical figures including a zero of larger size forming the outline of a face, a zero of smaller size representing an eye or a mouth, a two representing the back of the head and connected at right angles to the zero of larger size, a one of larger size, a four and a seven interchangeably connected at right angles to said zero of larger size and each representing a nose, a one of smaller size representing an eye-brow, a three representing a mustache, a five representing an eye, a six representing an ear, an eight representing eye-glasses and a nine representing an ear; each said numerical figure being provided with interconnection means for detachably and interchangeably connecting said figures together, some of said interconnection means being located on at least two of said surfaces of said bodies for interconnecting said bodies at right angles to each other, whereby said numerical figures can be interconnected in different ways to represent a three-dimensional human head having different facial expressions, suggestive of different human emotions.

* * * * *